US007066253B2

(12) United States Patent
Baker

(10) Patent No.: US 7,066,253 B2
(45) Date of Patent: Jun. 27, 2006

(54) CASING SHOE

(75) Inventor: Peter John Baker, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 212 days.

(21) Appl. No.: 10/433,254

(22) PCT Filed: Nov. 27, 2001

(86) PCT No.: PCT/GB01/05238

§ 371 (c)(1),
(2), (4) Date: May 30, 2003

(87) PCT Pub. No.: WO02/44514

PCT Pub. Date: Jun. 6, 2002

(65) Prior Publication Data

US 2004/0040704 A1 Mar. 4, 2004

(30) Foreign Application Priority Data

Dec. 1, 2000 (GB) ..... 0029324.1

(51) Int. Cl.
*E21B 17/14* (2006.01)

(52) U.S. Cl. ..... 166/242.8; 175/402

(58) Field of Classification Search ..... 175/402, 175/320, 323; 166/242.8
See application file for complete search history.

(56) References Cited

U.S. PATENT DOCUMENTS

| | | | | |
|---|---|---|---|---|
| 2,117,537 | A | 5/1938 | Baker | 166/9 |
| 3,095,644 | A | 7/1963 | Curry | 29/527 |
| 3,989,284 | A * | 11/1976 | Blose | 285/332.2 |
| 4,836,279 | A | 6/1989 | Freeman | 166/153 |
| 6,050,610 | A | 4/2000 | Enderle et al. | 285/94 |
| 6,062,326 | A | 5/2000 | Strong et al. | 175/402 |
| 6,148,924 | A * | 11/2000 | Shafer | 166/377 |
| 6,524,152 | B1 * | 2/2003 | Dauphin et al. | 441/133 |

FOREIGN PATENT DOCUMENTS

| | | |
|---|---|---|
| WO | WO 96/28635 | 9/1996 |
| WO | WO 99/37881 | 7/1999 |
| WO | WO 99/64713 | 12/1999 |

OTHER PUBLICATIONS

British Search Report dated Feb. 13, 2002, for application GB 0127999.1.
International Search Report dated Mar. 19, 2002 for application PCT/GB01/05238.

* cited by examiner

*Primary Examiner*—David Bagnell
*Assistant Examiner*—Daniel P Stephenson
(74) *Attorney, Agent, or Firm*—Patterson & Sheridan, LLP.

(57) ABSTRACT

A shoe for guiding a string within a well-bore comprises an annular body of relatively hard material and a nose portion of relatively soft material which are interlocked so that when the nose portion is drilled through, any remaining parts are held against the annular body. Interlocking is achieved by a dovetail thread. Embodiments are described for the shoe as a reamer shoe and as a drill bit to run in casing.

19 Claims, 3 Drawing Sheets

CASING SHOE

CROSS-REFERENCE TO RELATED APPLICATIONS

This application is a national stage entry under 35 U.S.C. § 371 of application PCT/GB01/05238, which claims priority to Great Britain Application GB0029324.1.

BACKGROUND OF THE INVENTION

1. Field of the Invention

The present invention relates to a shoe for use in wellbores as are typically utilized in oil and gas production.

2. Description of Related Art

In boring a region of an oil or gas well, a drill bit is typically mounted on the end of a "string". The "bit" or cutting pieces can be mounted on a shoe, and together these guide a "string" such as tubing, casing or liner through the wellbore as it is formed.

Alternatively, after boring a region of an oil or gas well a string of tools and/or tubing can be run into the wellbore. As the string is run it can meet obstructions as it travels through the wellbore. These obstructions may be ledges which form from well material during boring, formation wash-outs, or debris formed by unstable sections of the wellbore wall collapsing. Such obstructions can result in the string jamming in the wellbore. To prevent or minimize the effect of these obstructions, a shoe is conventionally mounted on the lower end of the string to guide the string through the centre of the wellbore.

The principle features of a shoe are to provide a guide during insertion of a string or tubing while being capable of being "drilled out" when the string or tubing is in position within a wellbore. The drilling out is necessary to provide a throughbore for the passage of fluids or further tool strings beyond the position of the shoe. To aid drilling out downhole, the shoe typically comprises a nose portion made of a relatively soft material, such as aluminum, zinc or alloys thereof which can easily be drilled through. The nose portion is mounted, traditionally by a standard unified screw thread, onto a stronger annular body. A suitable material for the body would be steel. The body may be a sub which houses cutting elements such as reamers, or alternatively the body may be the leading edge of the string or tubing which is being guided by the shoe.

After drill out, assuming the drill out is ideally concentric, there remains a continuous cylinder of the nose portion material threaded to the body of the shoe. However, the tolerance for the thickness is small, less than 1 cm, and any deviation of the drill during the drill out, i.e., non-concentric drilling, results in a high wear rate at one or more points of the cylinder. This can result in sections of the cylinder being completely drilled away and this local breach allows the remaining crescent shaped shell to peel away from the body with relatively little effort. The only resistance to this detachment being the greatly reduced bend strength of the crescent. The crescent which falls away can become trapped within the bore or casing and result in catastrophic problems, as it may obstruct the bore and cause the well to be unworkable.

BRIEF SUMMARY OF THE INVENTION

It is an object of the present invention to provide a shoe which, when bored through, leaves an annular body onto which is retained all remaining sections of the nose portion which have not been bored out.

According to a first aspect of the present invention, there is provided a shoe for guiding a string within a wellbore, the guide shoe comprising an annular body having a bore extending there through and a nose portion, wherein the nose portion is positively retained to the body by interlocking means.

Preferably the nose portion is located at a leading end of and partially within the body.

Preferably the interlocking means is located on an inner surface of the body and an outer surface of the nose portion.

Preferably the interlocking means is a dovetail thread. The thread may be right-hand or left-hand.

The dovetail thread may be located respectively on the inner surface of the body and the outer surface of the nose portion.

The interlocking means may include an adhesive material to assist in retaining the nose portion to the body. The adhesive may be Baker Lock (Trade Mark).

Preferably the nose portion is of unitary construction.

Alternatively, the nose portion may include cutting elements, such that the nose portion provides a drilling operation when rotated.

The nose portion may be constructed from a relatively soft material such as an aluminium or zinc alloy. The nose portion may include an internal channel for the passage of lubricating material to its surface on the leading edge. The nose portion may further include a bit guide to centre a drill bit of a boring out drill.

Preferably the annular body is of unitary construction.

The body may be constructed of a relatively hard material such as steel.

The body may be a sub which includes means for attaching a tool string or tubing, such as liner or casing.

The body may include on its outer surface reaming members which provide cutting elements. In use the cutting elements remove parts of the formation and so ream the borehole to allow ease of passage of the string. Such a shoe may be referred to as a reamer shoe.

Alternatively, the body may be a section of casing or liner. When the nose portion includes cutting elements and the body is a section of casing, the shoe may be referred to as a drill bit.

BRIEF DESCRIPTION OF THE DRAWINGS

Embodiments of the present invention will now be described, by way of example only, with reference to the following drawings of which.

Like parts to those shown in one view/embodiment are given the same nomenclature throughout the figures but are suffixed with a different letter in subsequent views/embodiments.

DETAILED DESCRIPTION

Figure 1:
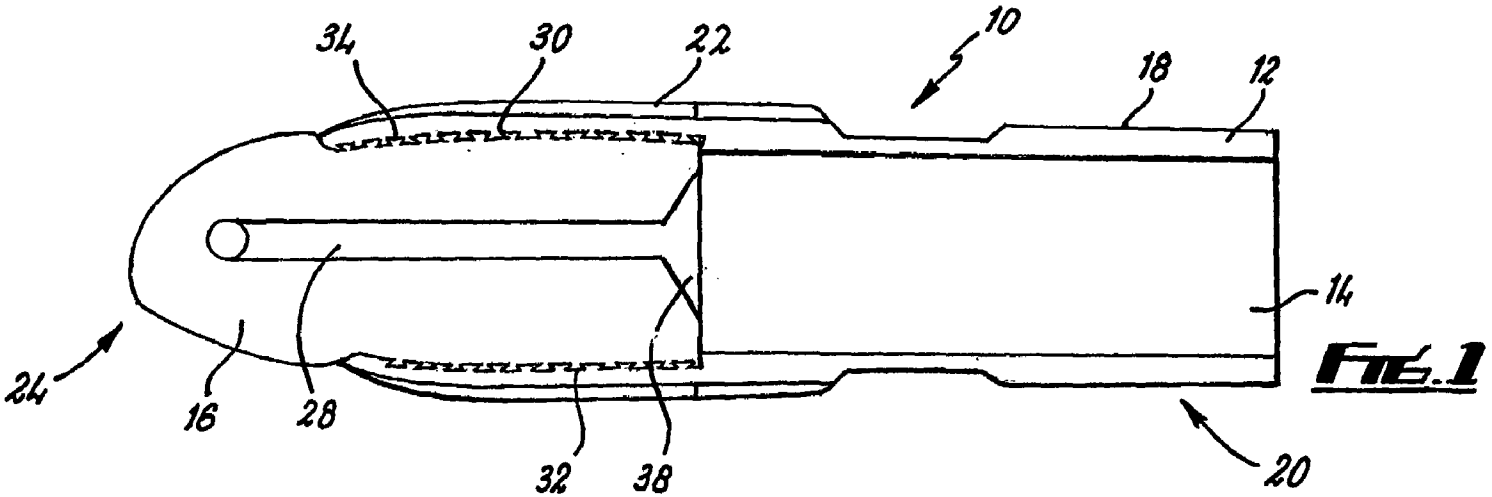
FIG. 1 a cross-sectional view of a shoe according to a first embodiment of the present invention.

Reference is first made to FIG. 1 of the drawings which depicts a shoe, generally indicated by reference numeral 10, according to a first embodiment of the present invention. The shoe 10 comprises an annular body 12 having a throughbore 14 and a nose portion 16 which is retained within the annular body 12 by an interlocking arrangement 30. The shoe 10 can be mounted on the lower end of a casing string (not shown). Typically mounting is achieved using threaded end connectors 18 located at the rear 20 of the body 10 which mate with the casing.

The body 12 is a sub and constructed from steel although any relatively hard material would be suitable. The nose portion 16 is of unitary construction from aluminum although any relatively soft material would be suitable.

The body 12 further comprises a reaming portion 22 which supports one or more reaming members. The reaming members are constructed from a hard resistant material such as polycrystalline diamond compact or tungsten carbide, or a combination of the two materials. The reaming members may extend fully or partially around the annular body 12. In use, the reaming members provide cutting elements to remove parts of the formation and so ream the borehole to allow ease of passage for the casing string through the wellbore. The guide shoe 10 of this embodiment is referred to as a reamer shoe.

The nose portion 16 comprises an eccentric leading edge 24 for ease of movement of the shoe 10 through the bore. The nose portion 16 further comprises a bit guide 38 into which a drill bit is located when the nose portion 16 is to be drilled out. The bit guide 38 centers the drill bit to assist in concentric drilling through the nose portion 16. The nose portion 16 also comprises a channel 28 which allows for the passage of a lubricating fluid in and around the shoe 10 to lubricate the surfaces of the shoe 10.

The nose portion 16 is positively retained to the annular body 12 by interlocking means 30. The interlocking means 30 are located on the rear outside surface of the nose portion 32 and on the forward inside surface of the annular body 34. Any hook and eye arrangement which restricts or prevents radial movement between the outer surface 32 and inner surface 34 is suitable as the interlocking means 30.

In the embodiment shown, the interlocking means 30 is a dovetail screw thread mating dovetail sections that are located on the outer surface 32 and inner surface 34. The nose portion 16 is screwed into the body 12 and positively retained by it.

When inserted in the borehole the shoe 10 is attached to a casing string. When the casing string is located at its final position, a drill bit is inserted into the throughbore 14 and located in the bit guide 38. The drill is rotated to bore out the nose portion 16 and leave a clear throughbore throughout the entire shoe 10. The bored out section of the nose portion 16 becomes drill cuttings and are disposed of by conventional means.

Figure 2:
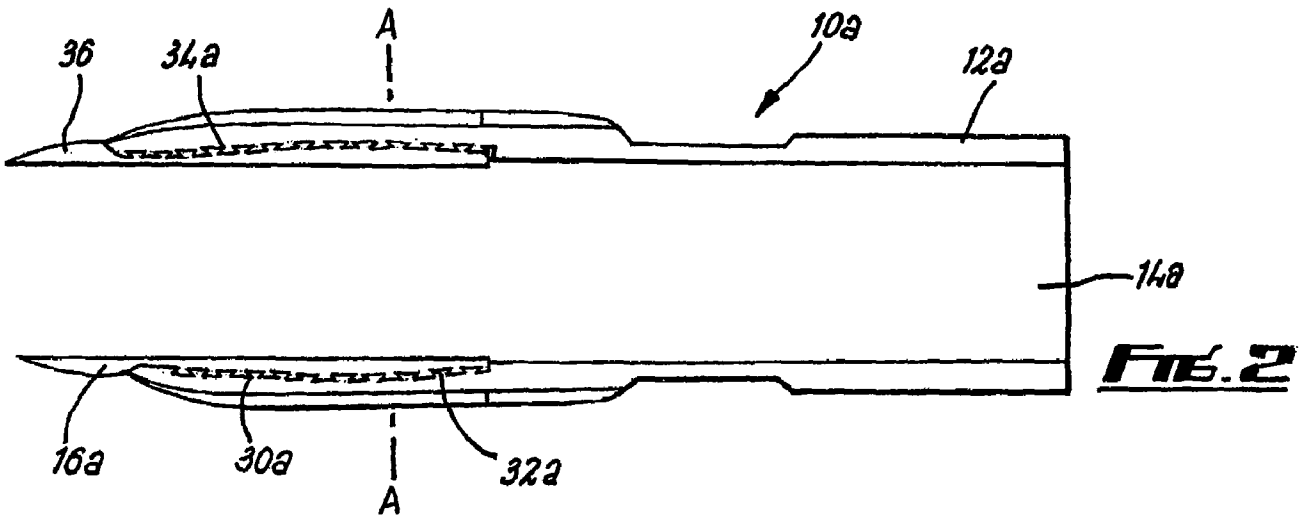
FIG. 2 a cross-sectional view of the guide shoe of FIG. 1 after concentric boring.
Figure 3A:
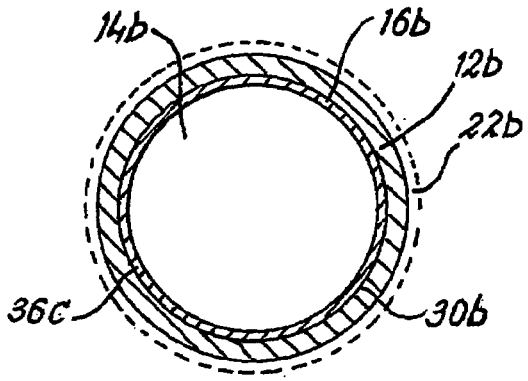
FIGS. 3(*a*) and 3(*b*) cross-sectional views taken through Section A–A' of FIG. 2 for (a) concentric drill-out and (b) non-concentric drill-out.
Figure 3B:
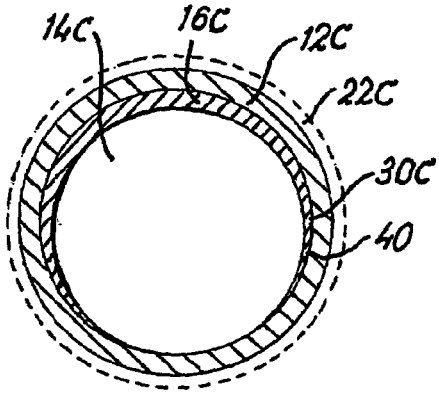

As shown in FIG. 2, when this is complete the shoe 10*a*, including a cylinder 36 of the nose portion 16*a*, remains attached to the casing string and is left in the borehole. This is shown through section A–A' in FIG. 3(*a*). The cylinder 36*c* is retained against the body 12*b* by the bend strength of the cylinder 36*c*. If the drill out operation has a non-concentric drilling profile for example as may occur if the drilling angle deviates from the centre, an area of the nose portion to one side of the body is bored out to a greater extent than that at the opposing side. This is shown in FIG. 3(*b*). The nose portion 16*c* has now been bored out to a crescent shaped shell 40. If the nose portion 16*c* had been attached to the body 12*c* by a unified screw thread, as in the prior art, the crescent 40 could be peeled away from the body 12*c* with relatively little effort. The only resistance being the greatly reduced bend strength of the crescent 40. In the event that the crescent 40 peels away from the body 12*c*, the crescent 40 can obstruct the bore and limit the use of the borehole. In the present invention, this peeling away of the crescent 40 from the body 12*c* is resisted by the positively retaining interlocking means 30*c*.

Figure 4A:
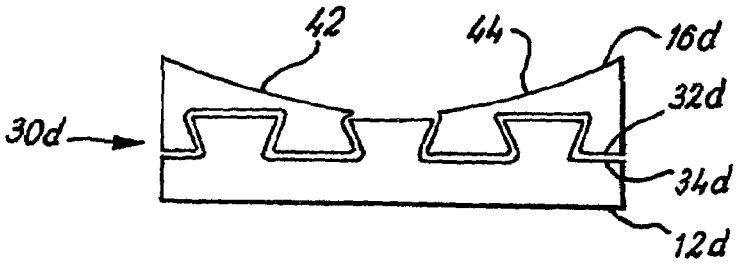
FIGS. 4(*a*) and 4(*b*) part cross-sectional views of interlocking means of an embodiment of the present invention when non-concentric drill-out as in FIG. 3(*b*), results in (a) sectioning of the remaining nose portion or (b) shearing of the body.
Figure 4B:
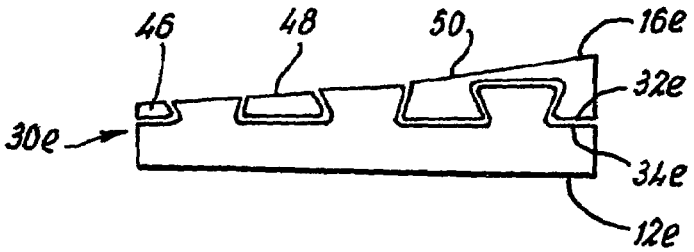

Reference is now made to FIGS. 4(*a*) and (*b*) of the drawings which illustrate the interlocking arrangement 30*d, e*, of the present invention. The interlocking arrangement 30*d,e* comprises a dovetail screw thread, as described hereinbefore with reference to FIGS. 1 and 2. The dovetail thread interconnects the body 12 with the nose portion 16. The benefit of the dovetail screw thread can be seen with reference to FIGS. 4(*a*) and 4(*b*) for cases where non-concentric drill out has occurred. In FIG. 4(*a*) it can seen that the nose portion 32*d* has been drilled through to the edge of the inside surface of the body 34*d*, as a result the nose portion has been portioned into segments 42 and 44. Each of the segments 42 and 44 cannot peel away from the inside surface 34*d*, as they are positively retained by the interlocking fixing between the nose portion 16*d* and the body 12*d*. The segments 42 and 44 of the nose portion 16*d* cannot move radially away from the body 12*d* and therefore cannot become detached.

If in the case where drilling out of the shoe results in the drill bit boring parts of the body 12*e*, as shown in FIG. 4(*b*), small sections of the nose portion 16*e*, segments 46, 48 and 50 may result. Due to the dovetail arrangement of the interlocking, the small segments 46 and 48, which remain will still be held against, i.e., positively retained by the body 12*e*. It has been calculated that for a dovetail screw thread with a nominal width of 0.125 inches and a 20 degree pitch, it would take a force of approximately 3,000 pounds to shear through each square inch of threaded area.

Figure 5:
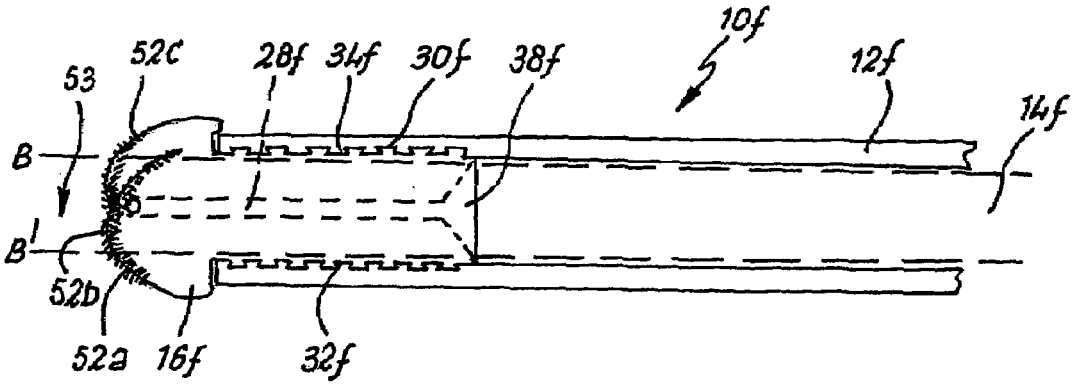
FIG. 5 a cross-sectional view of a shoe according to a second embodiment of the present invention.

Reference is now made to FIG. 5 of drawings, which illustrates a shoe, generally indicated by reference numeral 10*f*, according to a second embodiment of the present invention. Like parts to those of the first embodiment shown in FIG. 1 have been given the same nomenclature, but are suffixed "f". The shoe 10*f* comprises an annular body 12*f* which is a section of casing, and a nose portion 16*f*. The nose portion 16*f* is positively retained to the annular body 12*f* by interlocking means 30*f*. The interlocking means 30*f* are as described hereinbefore with reference to FIGS. 1 through 4.

The nose portion 16*f* includes cutting elements 52*a, b, c*. The cutting elements 52*a, b, c* are arranged on the leading edge of the nose portion 16*f* to form a drill bit 53, as is known in the art. The cutting elements are made of tungsten carbide. The shoe 10*f* of the second embodiment may be referred to as a drill bit. In use, the casing 12*f* is rotated and through the torque the drill bit 53 turns, so drilling a wellbore into which the casing 12*f* fits. When the casing 12*f* is in the required position, the nose portion 16*f* is drilled out as described hereinbefore, with interlocking means 30*f* positively retaining the remaining sections of the nose portion 16*f*, so that further shoes may be inserted through bore 14*f* to extend the wellbore beyond the end of the casing 12*f*.

Figure 6:
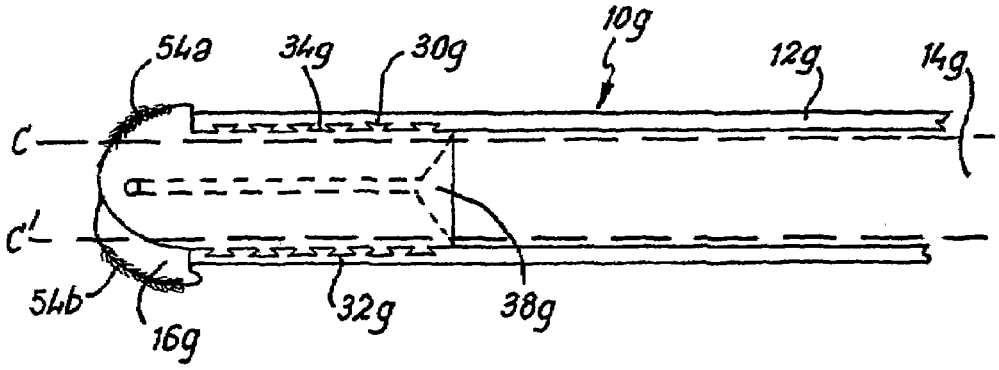
FIG. 6 a cross-sectional view of a shoe according to a third embodiment of the present invention.

It is known that drilling through tungsten carbide is a difficult process and the third embodiment of the present invention, shoe 10*g* in FIG. 6, illustrates a shoe 10*g* designed to assist in this. The shoe 10*g* is similar to the shoe 10 except that the cutting elements 54*a, b* extend only part way over the face of the nose portion 16*g*. On FIG. 6, lines C and C' indicate the section which is removed when the shoe 16*g* is drilled out.

Cutting elements 54*a, b* are arranged to be clear of this section, so that the drilling out procedure does not require drilling through the hard material of the cutting elements 54*a, b*.

The principle advantage of the present invention is in the ability of the body to positively retain all or even parts of the nose portion once the drilling out operation is complete so improving the reliability of the shoe.

It will be appreciated that modifications and improvements may be made to the embodiment hereinbefore described without departing from the scope of the invention. Such improvements may include the insertion of a slow setting adhesive in the screw thread which would aid the joining of the nose portion to the body by lubrication and increase the strength of the interlocking means when set. Additionally the embodiments described relate to a reamer shoe and a drill bit, those skilled in the art will appreciate that any shoe and string combination is within the scope of the invention.

The invention claimed is:

1. A shoe for guiding a string within a wellbore, comprising:

an annular body having a bore extending there through; and a nose portion positively retained to the body by an interlocking arrangement located on an inner surface of the body and an outer surface of the nose portion, characterized in that the interlocking arrangement is a dovetail thread and a minimum inner diameter defined by the interlocking arrangement is relatively larger than a bore inner diameter generally along a remainder of the annular body.

2. A shoe as claimed in claim 1 wherein the nose portion is located at a leading end of and partially within the body.

3. A shoe as claimed in claim 1 wherein interlocking arrangement includes an adhesive material to assist in retaining the nose portion to the body.

4. A shoe as claimed in claim 1 wherein the nose portion is of unitary construction.

5. A shoe as claimed in claim 1 wherein the nose portion includes cuffing elements, such that the nose portion provides a drilling operation when rotated.

6. A shoe as claimed in claim 1 wherein the nose portion is constructed from a relatively soft material.

7. A shoe as claimed in claim 1 wherein the nose portion includes an internal channel for the passage of lubricating material to its surface on the leading end.

8. A shoe as claimed in claim 1 wherein the nose portion further includes a bit guide to center a drill bit of a boring out drill.

9. A shoe as claimed in claim 1 where the annular body is of unitary construction.

10. A shoe as claimed in claim 1 wherein the body is constructed of a relatively hard material.

11. A shoe as claimed in claim 1 wherein the body is a sub which includes means for attaching to a tool string or tubing.

12. A shoe as claimed in claim 1 wherein the body includes on its outer surface reaming members which provide cutting elements.

13. A shoe as claimed in claim 1 wherein the body is a section of casing or liner.

14. A shoe for guiding a string within a wellbore, comprising:

an annular body having a bore extending there through; and a nose portion positively retained to the body by an interlocking arrangement, characterized in that the nose portion is of a unitary construction and a minimum inner diameter defined by the interlocking arrangement is relatively larger than a bore inner diameter generally along a remainder of the annular body.

15. A shoe as claimed in claim 14 wherein the nose portion is constructed from a relatively soft material.

16. A method of installing a tubular string in a borehole, comprising:

providing a shoe having a nose member positively retained to an annular body of the shoe by an interlocking arrangement;

inserting the tubular string into the borehole with the shoe attached to the tubular string; and drilling out a central section of the nose member leaving one or more portions of the nose member attached to the annular body, wherein the interlocking arrangement is positively retaining the one or more portions by preventing the one or more portions from moving in an inward radial direction upon drilling out the central section, wherein the interlocking arrangement is positively retaining the one or more portions that includes a crescent shaped shell section of the nose member due to non-concentric drilling out of the central section.

17. The method of claim 16, further comprising providing the interlocking arrangement that comprises a dovetail thread.

18. The method of claim 16, wherein retaining the one or more portions against the annular body is substantially only due to the interlocking arrangement positively retaining the one or more portions.

19. The method of claim 16, wherein the interlocking arrangement is positively retaining the one or more portions that include at least two separated sections of the nose member upon drilling out the central section.

* * * * *

UNITED STATES PATENT AND TRADEMARK OFFICE

CERTIFICATE OF CORRECTION

PATENT NO. : 7,066,253 B2
APPLICATION NO. : 10/433254
DATED : June 27, 2006
INVENTOR(S) : Peter John Baker It is certified that error appears in the above-identified patent and that said Letters Patent is hereby corrected as shown below:

In the Claims

Column 5, Claim 5, Line 49: Change "cuffing" to --cutting--

Signed and Sealed this

Thirtieth Day of January, 2007

JON W. DUDAS
*Director of the United States Patent and Trademark Office*